US010289073B2

(12) United States Patent
Morohoshi

(10) Patent No.: US 10,289,073 B2
(45) Date of Patent: May 14, 2019

(54) INFORMATION DISPLAY DEVICE AND COMPUTER-READABLE STORAGE MEDIUM

(71) Applicant: CASIO COMPUTER CO., LTD., Tokyo (JP)

(72) Inventor: Hiroshi Morohoshi, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/460,674

(22) Filed: Mar. 16, 2017

(65) Prior Publication Data

US 2017/0371302 A1 Dec. 28, 2017

(30) Foreign Application Priority Data

Jun. 23, 2016 (JP) ..... 2016-124384

(51) Int. Cl.

| | |
|---|---|
| ***G04G 9/00*** | (2006.01) |
| ***G04B 19/20*** | (2006.01) |
| ***G04B 19/04*** | (2006.01) |
| ***G04C 3/14*** | (2006.01) |

(52) U.S. Cl.

CPC ..... *G04G 9/0076* (2013.01); *G04B 19/048* (2013.01); *G04B 19/202* (2013.01); *G04C 3/14* (2013.01); *G04G 9/0064* (2013.01)

(58) Field of Classification Search

CPC ..... G04G 9/0076; G04G 9/0064; G04G 9/00; G04B 19/202; G04B 19/048; G04B 19/20; G04B 19/04; G04C 3/14

See application file for complete search history.

(56) References Cited

U.S. PATENT DOCUMENTS

| | | | | |
|---|---|---|---|---|
| 3,702,530 | A * | 11/1972 | Besson | G04B 19/25 368/319 |
| 8,717,855 | B2 * | 5/2014 | Sato | G04B 19/087 368/223 |
| 8,730,769 | B2 * | 5/2014 | Sato | G04B 19/065 116/298 |
| 8,971,153 | B2 * | 3/2015 | Takenawa | G04C 17/0058 368/35 |
| 2004/0013042 | A1 * | 1/2004 | Farine | G04B 47/048 368/10 |

(Continued)

FOREIGN PATENT DOCUMENTS

JP 2005-83979 A 3/2005

*Primary Examiner* — Sean P Kayes
(74) *Attorney, Agent, or Firm* — Chen Yoshimura LLP

(57) ABSTRACT

An information display device includes: a position changing unit that changes a position of an information indicator in accordance with a type of information to be displayed by the information indicator; and an operation unit that causes the position changing unit to change the position of the information indicator that represents one type of information to a new position that represents another type of information, the operation unit causing the position changing unit to perform a movement completion operation for indicating to a viewer that the type of information displayed has been changed, in accordance with the another type of the information to be displayed when the position changing unit finishes changing the position of the information indicator to the new position.

12 Claims, 8 Drawing Sheets

(56) References Cited

U.S. PATENT DOCUMENTS

| | | | | |
|---|---|---|---|---|
| 2007/0014193 | A1* | 1/2007 | Plancon | G04B 19/082<br>368/80 |
| 2013/0051198 | A1* | 2/2013 | Sato | G04B 19/065<br>368/235 |
| 2015/0253739 | A1* | 9/2015 | Iida | G04G 9/00<br>368/80 |

* cited by examiner

INFORMATION DISPLAY DEVICE AND COMPUTER-READABLE STORAGE MEDIUM

BACKGROUND OF THE INVENTION

Technical Field

The present invention relates to an information display device and a computer-readable storage medium.

Background Art

Some conventional electronic timepieces have a function for displaying the date in addition to hours, minutes, and seconds. This date display function is realized by a disk-shaped functional hand provided in a lower area of a face plate, for example. A window is provided in the face plate such that a single sign provided on an upper surface of the disk-shaped functional hand is selectively exposed from above. This disk-shaped functional hand will be called simply a "disk" hereinafter. During normal rotation of the disk, in the clockwise direction, the electronic timepiece stops the disk at a target position. During reverse rotation of the disk, in the counterclockwise direction, the disk is stopped at the target position after first taking up backlash. This makes it possible to appropriately correct the display position of the disk.

Recent progress in electronic technologies has led to demand that electronic timepieces be able to display various types of information. Timepieces that combine analog timekeeping with digital displays are also appearing. The abstract of Japanese Patent Application Laid-Open Publication No. 2005-83979 discloses the following: "A driving pointer is switched according to the consumption state of the battery, and information which cannot be displayed by pointer stop is displayed on the digital display part 11, to thereby elongate the time display function."

Electronic timepieces that use disks rather than digital displays to display various types of information are also appearing. Information displayed by a disk includes an operating mode of the timepiece, an indication of whether or not daylight savings time is in effect, and an indication of whether an alarm is on or off, for example. There are also electronic timepieces that in addition to the primary date/time display (a primary clock) have world time functions capable of displaying the time in various parts of the world (a secondary clock).

Such electronic timepieces include, for example, clocks capable of simultaneously displaying the primary clock and the date/time of another location using a secondary clock or a sub-clock, as well as timepieces that can selectively display either the primary clock or the secondary clock in response to a switching operation made using an operation button. This world time function enables the user of the electronic timepiece to quickly know the date/time at multiple locations, for a variety of applications. Such applications include a combination of the time at the current location and the time at another location essential for work, a combination of the time at a travel destination and the time at a home location where the user normally resides, and so on.

However, such electronic timepieces have been problematic in that it is difficult for the user to know that the information being displayed has switched to new information.

What is needed, therefore, is a way of making it easier for the user to know that the information has switched to new information in situations such as when a city used in the world time function is specified in response to a user operation.

Accordingly, the present invention aims to make obvious the timing at which displayed information is switched in an information display device. Thus, the present invention is directed to a scheme that substantially obviates one or more of the problems due to limitations and disadvantages of the related art.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an information display device, including: a position changing unit that changes a position of an information indicator in accordance with a type of information to be displayed by the information indicator; and an operation unit that causes the position changing unit to change the position of the information indicator that represents one type of information to a new position that represents another type of information, the operation unit causing the position changing unit to perform a movement completion operation for indicating to a viewer that the type of information displayed has been changed, in accordance with the another type of the information to be displayed when the position changing unit finishes changing the position of the information indicator to the new position.

In another aspect, the present disclosure provides a computer-readable non-transitory storage medium having stored therein instructions executable by a processor of an information display device including a position changing unit that changes a position of an information indicator, the instructions causing the processor to perform the following: causing the position changing unit to change the position of the information indicator in accordance with a type of information to be displayed by the information indicator; and causing the position changing unit to change the position of the information indicator that represents one type of information to a new position that represents another type of information, the position changing unit being caused to perform a movement completion operation for indicating to a viewer that the type of information displayed has been changed, in accordance with the another type of the information to be displayed when the position changing unit finishes changing the position of the information indicator to the new position.

It is to be understood that both the foregoing general description and the following detailed description are exemplary and explanatory, and are intended to provide further explanation of the invention as claimed.

DETAILED DESCRIPTION OF EMBODIMENTS

Hereinafter, embodiments of the present invention will be described in detail with reference to the drawings.

Figure 1:
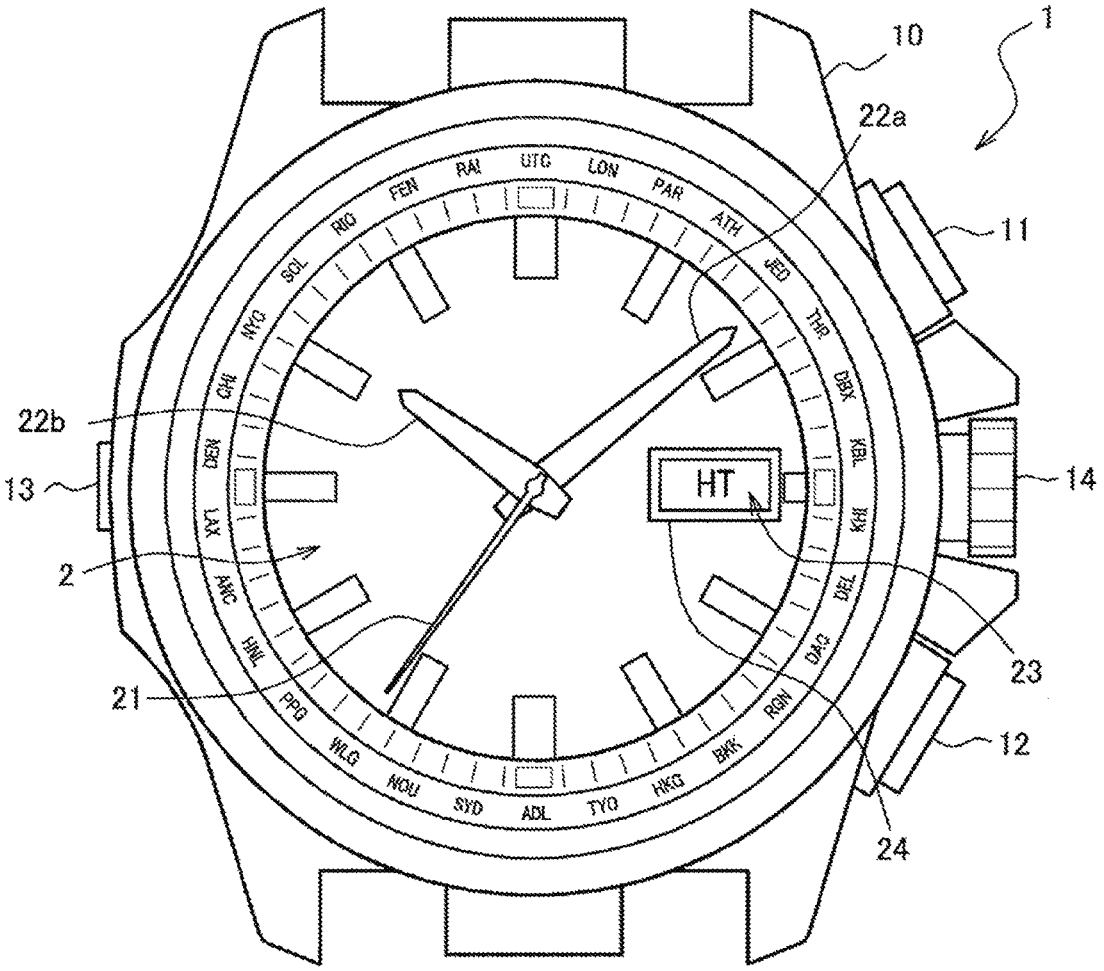
FIG. 1 is a schematic diagram illustrating the external appearance of an electronic timepiece according to an embodiment.

FIG. 1 is a front view of an electronic timepiece 1 according to the present embodiment.

As illustrated in FIG. 1, in this electronic timepiece 1 (information display device), a face plate 2 is provided within a frame 10. Pushbutton switches 11, 12, and 13 and a crown 14 are provided on a side surface of the frame 10. A second hand 21, a minute hand 22*a*, and an hour hand 22*b* are disposed on a display surface side (upper surface side) of the face plate 2. A disk 23 is disposed below the face plate 2. The face plate 2, the second hand 21, the minute hand 22*a*, the hour hand 22*b*, and the disk 23 constitute a display unit.

The pushbutton switches 11, 12, and 13 and the crown 14 are operation units that accept input operations from the exterior. The pushbutton switches 11, 12, and 13 accept pushing operations from the exterior. The crown 14 is pulled out from a default position to accept rotational operations.

A clear windshield covers upper surfaces of face plate 2, the second hand 21, the minute hand 22*a*, and the hour hand 22*b*. Various elements involved in driving and controlling the electronic timepiece 1, as well as a power source unit (not illustrated), are provided below a lower surface of the disk 23 (the opposite side from the side of the disk 23 facing the face plate 2) within the frame 10. These elements and power source are covered by a rear cover, which is not illustrated.

Marks and signs for realizing displays for the time and various other functions are provided on the face plate 2. Additionally, a window 24 is provided in the face plate 2 at the three o'clock location, and signs on the disk 23 are selectively exposed through the window 24.

The second hand 21, the minute hand 22*a*, and the hour hand 22*b* are provided capable of rotating in a plane parallel to the face plate 2, with what is substantially the center of the face plate 2 serving as the axis of rotation. The disk 23 is an annular member (including disk-shaped members), capable of rotating, that is provided parallel to the face plate 2 on the lower surface side of the face plate 2. Signs indicating various types of information are provided in order at equal intervals along the circumference of the disk 23. When the disk 23 is rotated, one of the signs is selectively exposed through the window 24.

Figure 2:
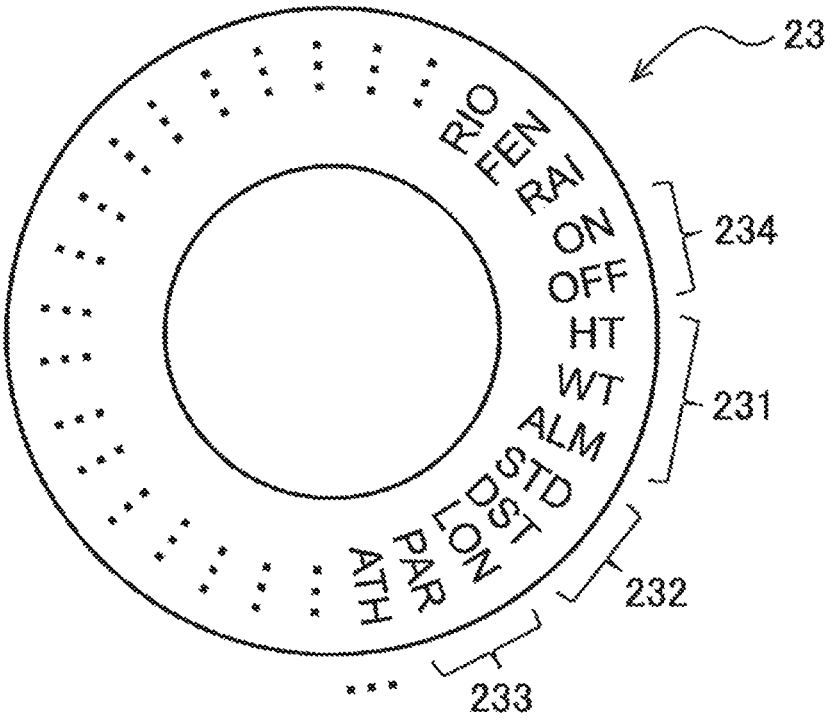
FIG. 2 is a diagram illustrating signs provided on a disk.

FIG. 2 is a diagram illustrating signs provided on the disk 23.

"HT," which indicates a home time mode, "WT," which indicates a world time mode, and "ALM," which indicates an alarm mode, are inscribed in the disk 23 as mode signs 231. The modes indicated by the mode signs 231 are broader concepts than the items indicated by the other signs, and are broader classifications.

"STD," which indicates standard time, and "DST," which indicates daylight savings time, are inscribed as time signs 232. "ON," which indicates that an alarm is on, and "OFF," which indicates than the alarm is off, are inscribed as alarm signs 234. City signs 233, which indicate various cities for world times, are inscribed in the remaining regions. "LON" indicates London, "PAR" indicates Paris, and "ATH" indicates Athens. "RIO" indicates Rio de Janiero, "FEN" indicates Fernando de Noronha, and "RAI" indicates Praia. The signs from "ATH" to "RIO" are not illustrated, but abbreviations of major cities around the world are in fact inscribed in those areas.

Figure 3:
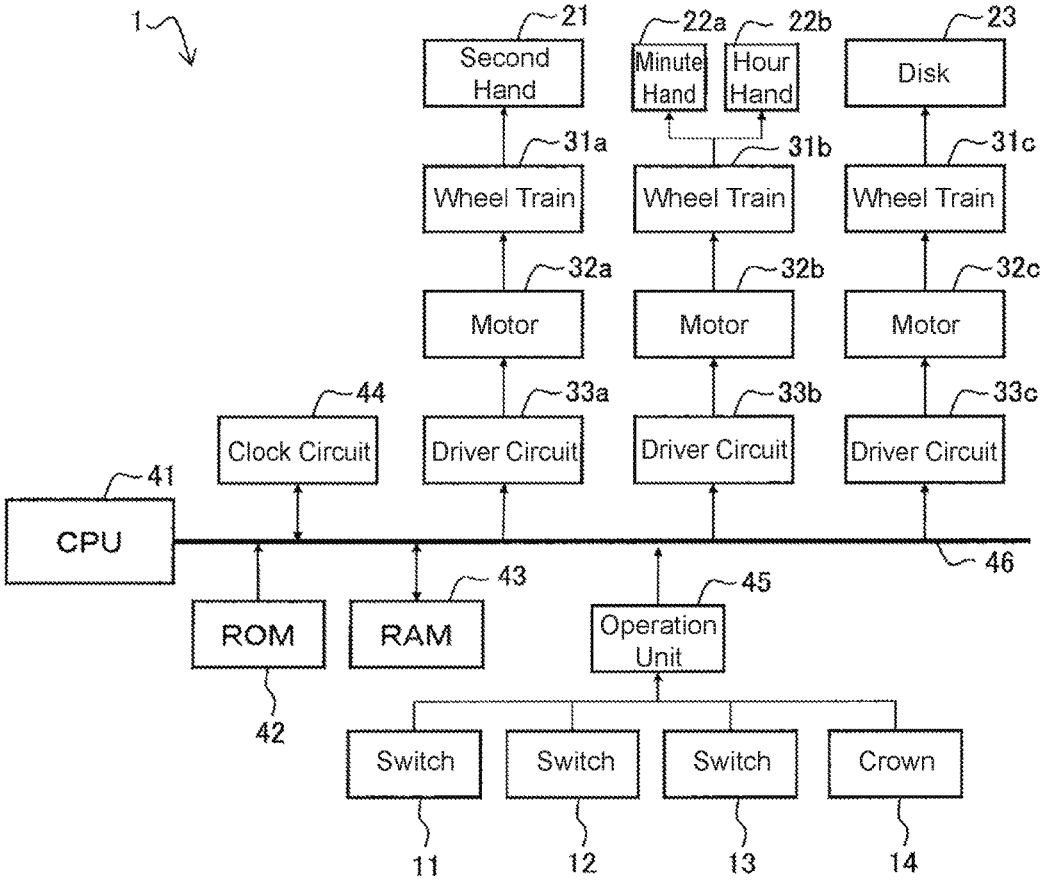
FIG. 3 is a block diagram illustrating the functional configuration of the electronic timepiece.

FIG. 3 is a block diagram illustrating the functional configuration of the electronic timepiece 1.

The electronic timepiece 1 includes a central processing unit (CPU) 41, read-only memory (ROM) 42, random access memory (RAM) 43, a timing circuit 44, and an operating unit 45. The electronic timepiece 1 further includes gear train mechanisms 31*a* to 31*c*, stepping motors 32*a* to 32*c*, and driver circuits 33*a* to 33*c* that drive corresponding stepping motors, as elements handling driving control. These elements exchange commands, data, and so on through a bus 46.

Each of the gear train mechanisms 31*a* to 31*c* is constituted of a plurality of gear trains.

The gear train mechanism 31*a* transmits stepping movement of the stepping motor 32*a* to the second hand 21 so as to rotate the second hand 21 by a prescribed angle at a time. The second hand 21 is used to display the time, and is also used when employing the signs indicating city names provided on the frame 10 to set a home location, a local location for world timekeeping, and so on.

The gear train mechanism 31*b* transmits stepping movement of the stepping motor 32*b* to the minute hand 22*a* and the hour hand 22*b* so as to rotate the minute hand 22*a* and the hour hand 22*b* prescribed angles at a time. The rotation angle of the hour hand 22*b* when the stepping motor 32*b* moves by one step is 1/12 the rotation angle of the minute hand 22*a*.

The gear train mechanism 31*c* transmits rotational movement of the stepping motor 32*c* to the disk 23 to rotate the disk 23 to a prescribed position. The disk 23 rotates in accordance with various types of information specified by the user, and the sign exposed through the window 24 changes as a result. The disk 23 makes one complete revolution with 4,650 steps' worth of driving of the stepping motor 32*c*. Thirty-one different signs are inscribed on the disk 23, and it therefore takes 150 steps to move between adjacent signs. The gear train mechanism 31*c* takes 20 steps' worth of driving of the stepping motor 32*c* to take up backlash.

The driver circuits 33*a* to 33*c* output driving voltage pulses at appropriate timings and pulsewidths to drive the corresponding stepping motors 32*a* to 32*c*. The width of the driving voltage pulse can be appropriately adjusted by control signals from the CPU 41. Meanwhile, in the case where a control signal that drives a plurality of the stepping motors simultaneously is inputted, the driver circuits 33*a* to 33*c* output the driving voltage pulses such that the driving timings are shifted as appropriate in accordance with the maximum load of the electronic timepiece 1, within a range that does not cause problems.

The driver circuits 33*a* to 33*c*, the stepping motors 32*a* to 32*c*, and the gear train mechanisms 31*a* to 31*c* constitute position changing units that change the position of the corresponding hand on the basis of information to be displayed.

The CPU 41 controls the overall operations of the electronic timepiece 1 by carrying out various types of computational processes. The CPU 41 also makes display settings for the current location and world timekeeping, display settings for whether the alarm is on or off, and display settings for daylight savings time and standard time. The CPU 41 furthermore makes display settings for home time, world time, and alarm modes. The CPU 41 also functions as an operation unit that causes a stopping operation to be carried out in accordance with the type of information displayed by the disk 23 when the operation for changing the position of the disk 23 ends.

The ROM 42 stores control programs, configuration data, and so on related to operations of the electronic timepiece 1. The ROM 42 may also include a non-volatile memory such as a rewritable flash memory, and in such a case, the ROM 42 may be rewritten in accordance with changes to the control program or the like.

The RAM 43 is a volatile memory, storing temporary data and configuration data that can be updated, that provides a working memory space for the CPU 41. The configuration data that can be updated includes location information pertaining to the home location indicating a primary location of a user, location information pertaining to a local location at which a world timekeeping display is to be made using the disk 23, and so on.

The timing circuit 44 counts and holds a current date/time on the basis of a clock signal having a prescribed frequency generated by an oscillation circuit (not illustrated). The date/time held by the timing circuit 44 may be a proprietary system time used by the electronic timepiece 1. Alternatively, the date/time may be based on a Coordinated Universal Time (UTC) date/time.

The operating unit 45 detects pushing operations of the pushbutton switches 11, 12, and 13, and pull-out, push-in, and rotational operations of the crown 14, and outputs input signals based on the type of operation to the CPU 41.

Figure 4:
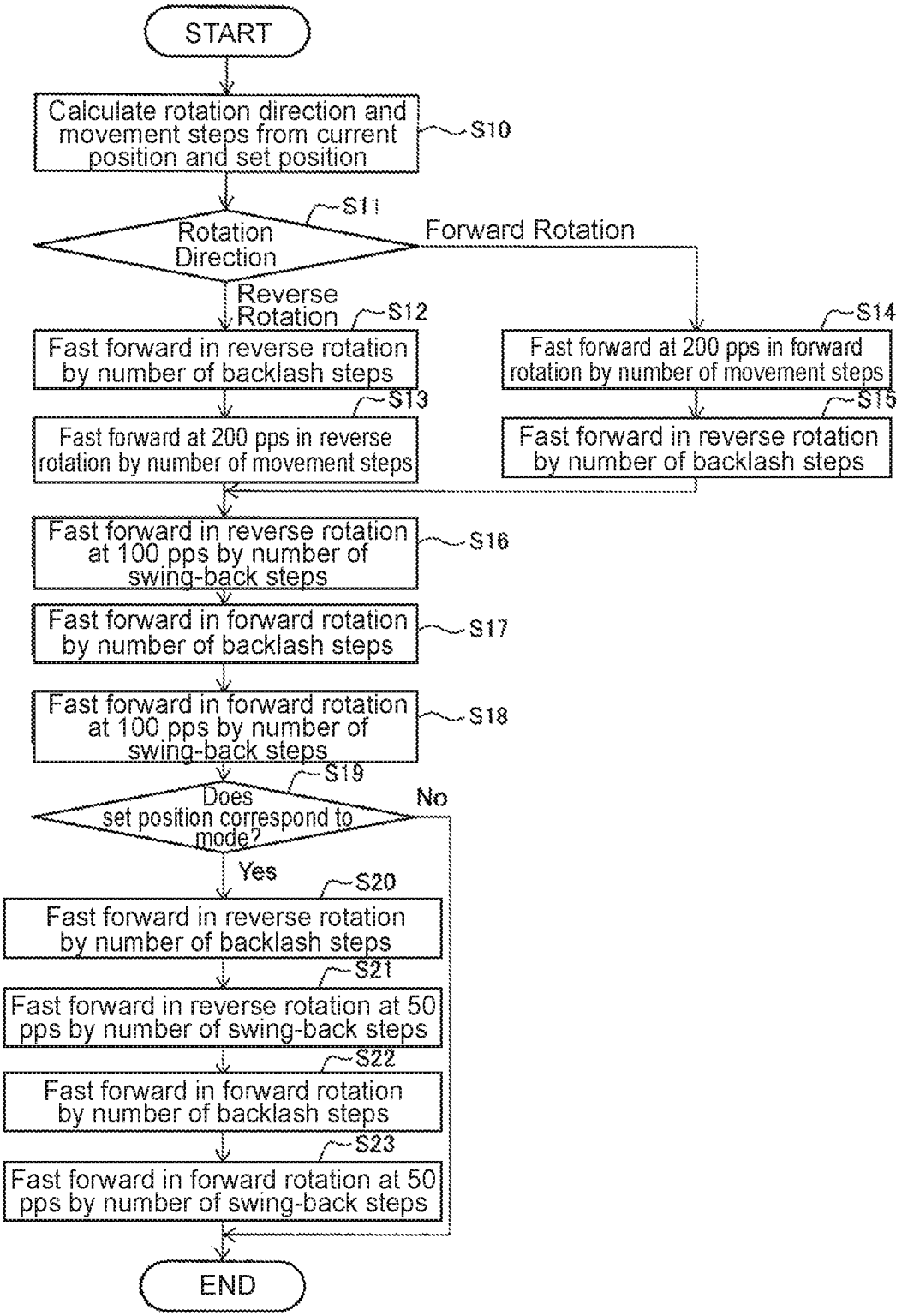
FIG. 4 is a flowchart illustrating a fast-forward process of the electronic timepiece.

FIG. 4 is a flowchart illustrating a fast-forward process of the electronic timepiece 1.

The fast-forward process illustrated in FIG. 4 is started when the user carries out a prescribed setting operation.

First, the CPU 41 calculates a set position for displaying the current settings, and calculates the current position along with a rotation direction and movement steps from the set position (step S10). Note that the CPU 41 calculates the steps for moving from the current position to the set position in both the normal direction and the reverse direction, and takes the direction providing fewer movement steps as the rotation direction. For example, when "OFF" is set, it takes 150 steps in the normal rotation direction to move from the "HT" display position to the "OFF" display position. Meanwhile, when "WT" is set, it takes 20 steps in the reverse rotation direction to take up backlash and 150 steps in the reverse rotation direction, for a total of 170 steps, to move from the "HT" display position to the "WT" display position.

If the calculated rotation direction is the reverse rotation direction (step S11→reverse rotation), the CPU 41 fast-forwards in reverse rotation by the number of backlash steps (20 steps) (step S12). The CPU 41 then fast-forwards in reverse rotation by the number of movement steps (step S13). Both fast-forwards are carried out at a speed of 200 pulses per second (pps).

If the calculated rotation direction is the normal rotation direction (step S11→normal rotation), the CPU 41 fast-forwards in normal rotation by the number of movement steps (step S14). The CPU 41 then fast-forwards in reverse rotation by the number of backlash steps (20 steps) (step S15). Both fast-forwards are carried out at a speed of 200 pps.

After steps S13 and S15, the CPU 41 carries out a stopping operation through swing-back.

The CPU 41 fast-forwards in the reverse rotation direction by a number of swing-back steps (50 steps) (step S16). This enables the CPU 41 to shift the sign displayed in the window 24 upward. This fast-forwarding is carried out at a speed of 100 pps, which is half the speed of the fast-forwarding from the current position to the set position. This makes it possible for the stopping operation to catch the attention of the user.

Next, the CPU 41 fast-forwards in normal rotation by the number of backlash steps (20 steps) (step S17). This fast-forward is carried out at a speed of 200 pps.

The CPU 41 furthermore fast-forwards in the normal rotation direction by the number of swing-back steps (50 steps) (step S18). This enables the CPU 41 to return the sign that was shifted upward back to the center of the window 24. This fast-forwarding is carried out at a speed of 100 pps, which is half the speed of the fast-forwarding from the current position to the set position. This makes it possible for the stopping operation to catch the attention of the user.

The CPU 41 then judges whether or not the set position corresponds to a mode (step S19). "Mode" corresponds to the home time mode, the world time mode, or the alarm mode, and is a broader concept (a broader classification) than the displays made by the other signs. If the set position does not correspond to a mode (step S19→No), the CPU 41 ends the processing of FIG. 4, whereas if the set position does correspond to a mode (step S19→Yes), the CPU 41 once again carries out a stopping operation through swing-back.

The CPU 41 fast-forwards in reverse rotation by the number of backlash steps (20 steps) (step S20). This fast-forward is carried out at a speed of 200 pps.

The CPU 41 fast-forwards in the reverse rotation direction by a number of swing-back steps (50 steps) (step S21). This enables the CPU 41 to shift the sign displayed in the window 24 upward. This fast-forward is carried out at a speed of 50 pps, which is half the speed of the previous swing-back. This makes it possible for the stopping operation pertaining to the mode to catch the attention of the user.

Next, the CPU 41 fast-forwards in normal rotation by the number of backlash steps (20 steps) (step S22). This fast-forward is carried out at a speed of 200 pps.

The CPU 41 furthermore fast-forwards in the normal rotation direction by the number of swing-back steps (50 steps) (step S23). This enables the CPU 41 to return the sign that was shifted upward back to the center of the window 24. This fast-forward is carried out at a speed of 50 pps, which is half the speed of the previous swing-back. This makes it possible for the stopping operation pertaining to the mode to catch the attention of the user.

The CPU 41 ends the processing of FIG. 4 once the process of step S23 ends.

<Example of Operation in Normal Rotation Direction>

Next, operations for moving from an "HT" display position to an "OFF" display position, which has been newly set, will be described using FIGS. 5 and 6. This is an operation in the normal rotation direction.

Figure 5:
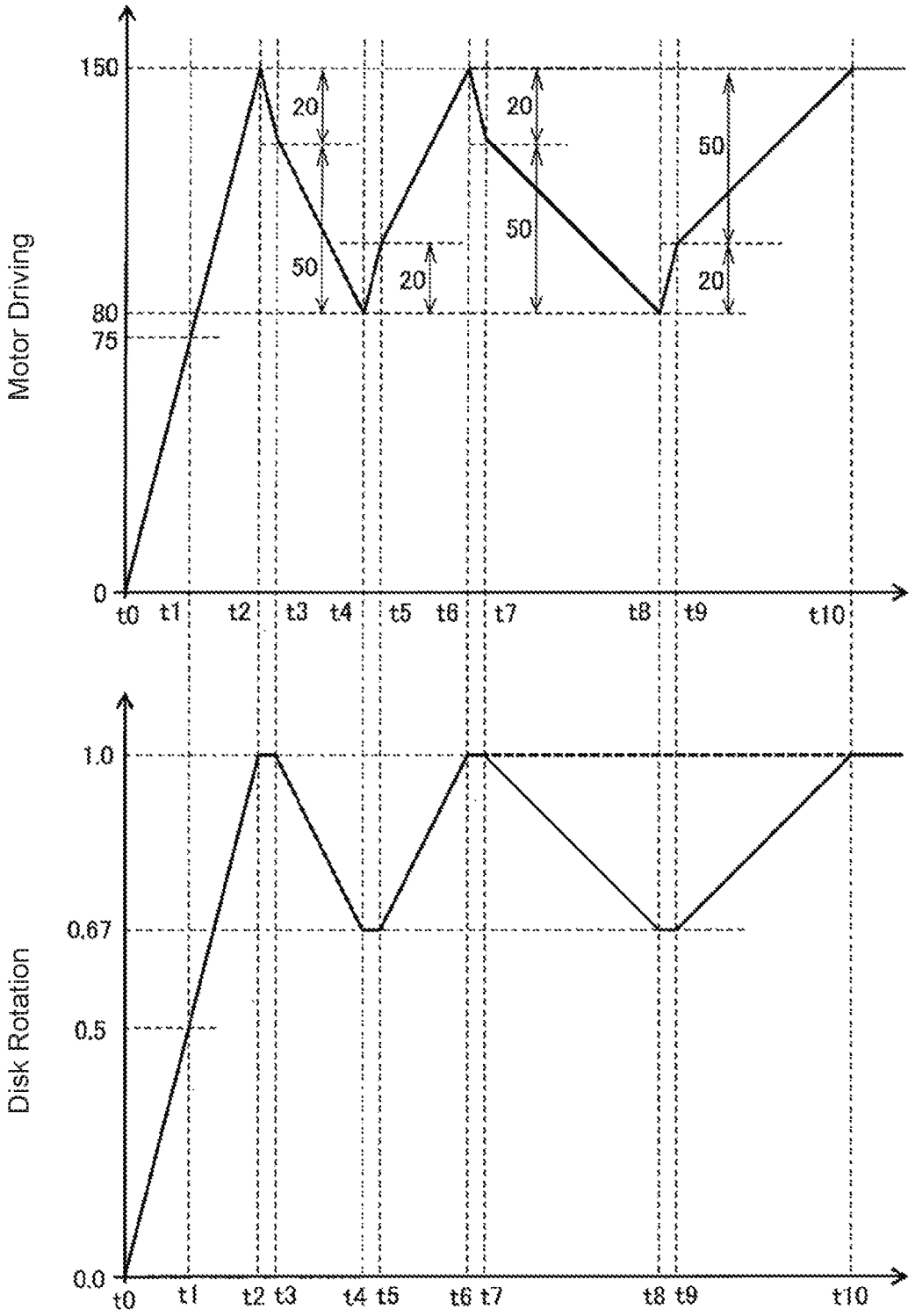
FIG. 5 is a graph illustrating an example of operations in a normal rotation direction.

FIG. 5 is a graph illustrating an example of the operations in the normal rotation direction. The graph in the upper part of FIG. 5 indicates the driving steps of the stepping motor 32*c*, whereas the graph in the lower part indicates the movement of the disk 23. The horizontal axes in both graphs indicate corresponding times. FIG. 6 illustrates the signs (information) displayed in the window 24 at some of the times indicated in FIG. 5.

Figure 6:
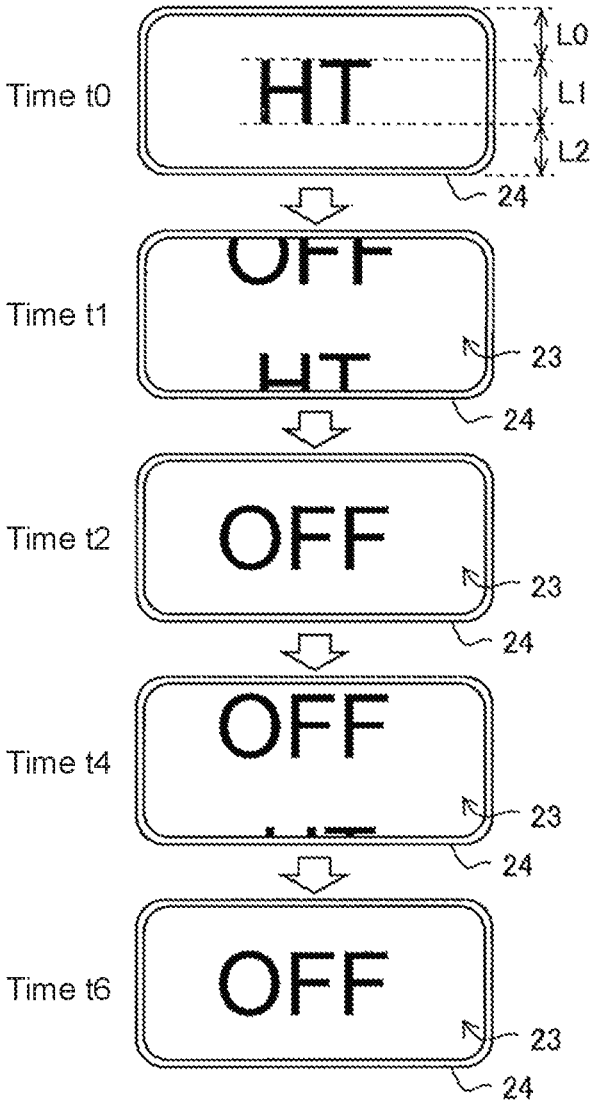
FIG. 6 is a diagram illustrating an example of a display during normal rotation.

As illustrated in FIG. 6, at time t0, the disk 23 displays "HT" in the center of the window 24. The letters "HT" are at a height L1. The window 24 has a margin of L0 above the letters "HT" and a margin of L2 below the letters "HT." The following descriptions will assume that this position corresponds to a driving step of 0 and a rotation of 0 for the disk 23.

As illustrated in FIG. 5, from time t0 to time t2, the stepping motor 32*c* rotates in the normal rotation direction for 150 steps at a speed of 200 pps.

Time t1 is midway between time t0 and time t2. At time t1, the disk 23 displays a position midway between "HT" and "OFF" in the window 24. As illustrated in FIG. 5, at time t1, the driving step is 75 and the rotation of the disk 23 is 0.5.

As illustrated in FIG. 6, at time t2, the disk 23 displays "OFF" in the center of the window 24. As illustrated in FIG. 5, at time t2, the driving step is 150 and the rotation of the disk 23 is 1.0. Then, from time t2 to time t3, the stepping motor 32*c* rotates in the reverse rotation direction for 20 steps at 200 pps. This enables the electronic timepiece 1 to take up backlash in the reverse rotation direction.

At time t3, the disk 23 continues to display "OFF" in the center of the window 24. At time t3, the driving step is 130 and the rotation of the disk 23 is 1.0. From time t3 to time t4, the stepping motor 32*c* rotates in the reverse rotation direction for 50 steps at 100 pps. This enables the electronic timepiece 1 to shift the sign displayed in the window 24 upward. Here, the amount of swing-back produced in the disk 23 by the 50 steps of rotation of the stepping motor 32*c* is smaller than the margin L0 indicated in FIG. 6. As such, the information can continue to be correctly displayed in the window 24 during the swing-back, which makes it obvious where the disk 23 stopped moving.

The rotation speed of the stepping motor 32*c* is 100 pps during the swing-back, which is different from the rotation speed when the display of the disk 23 is changed from "HT" to "OFF." Thus, the electronic timepiece 1 can make the swing-back operation (the stopping operation) obvious.

As illustrated in FIG. 6, at time t4, the disk 23 displays "OFF" in an upper part of the window 24. At time t4, the driving step is 80 and the rotation of the disk 23 is 0.67. The first swing-back is carried out in this manner. Then, from time t4 to time t5, the stepping motor 32*c* rotates in the normal rotation direction for 20 steps at 200 pps. This makes it possible to take up backlash in the normal rotation direction.

At time t5, the driving step is 100 and the rotation of the disk 32 is 0.67. Then, from time t5 to time t6, the stepping motor 32*c* rotates in the normal rotation direction for 50 steps at 100 pps. This enables the electronic timepiece 1 to return the sign that was shifted upward back to the center of the window 24.

As illustrated in FIG. 6, in the case where the disk 23 displays "OFF" in the center of the window 24 at time t6, no further swing-back is carried out, as indicated by the bold broken line. However, in the case where the disk 23 displays "HT," "WT," or "ALM" in the center of the window 24, one additional swing-back is carried out, as indicated by the bold solid line. This operation will be described next.

From time t6 to time t7, the stepping motor 32*c* rotates in the reverse rotation direction for 20 steps at 200 pps. This enables the electronic timepiece 1 to take up backlash in the reverse rotation direction.

At time t7, the driving step is 130 and the rotation of the disk is 1.0. From time t7 to time t8, the stepping motor 32*c* rotates in the reverse rotation direction for 50 steps at 50 pps. This enables the electronic timepiece 1 to shift the sign displayed in the window 24 upward.

The rotation speed of the stepping motor 32*c* is 50 pps in the second swing-back, which is different from the rotation speed during the first swing-back. Thus, the electronic timepiece 1 can make it obvious that the swing-back operation is the second swing-back operation.

At time t8, the driving step is 80 and the rotation of the disk is 0.67. The second swing-back is carried out in this manner. From time t8 to time t9, the stepping motor 32*c* rotates in the normal rotation direction for 20 steps at 200 pps. This enables the electronic timepiece 1 to take up backlash in the normal rotation direction.

At time t9, the driving step is 100 and the rotation of the disk is 0.67. Then, from time t9 to time t10, the stepping motor 32*c* rotates in the normal rotation direction for 50 steps at 100 pps. This enables the electronic timepiece 1 to return the sign that was shifted upward back to the center of the window 24.

<Example of Operation in Reverse Rotation Direction>

Next, operations for moving from an "HT" display position to a "WT" display position, which has been newly set, will be described using FIGS. 7 and 8. This is an operation in the reverse rotation direction.

Figure 7:
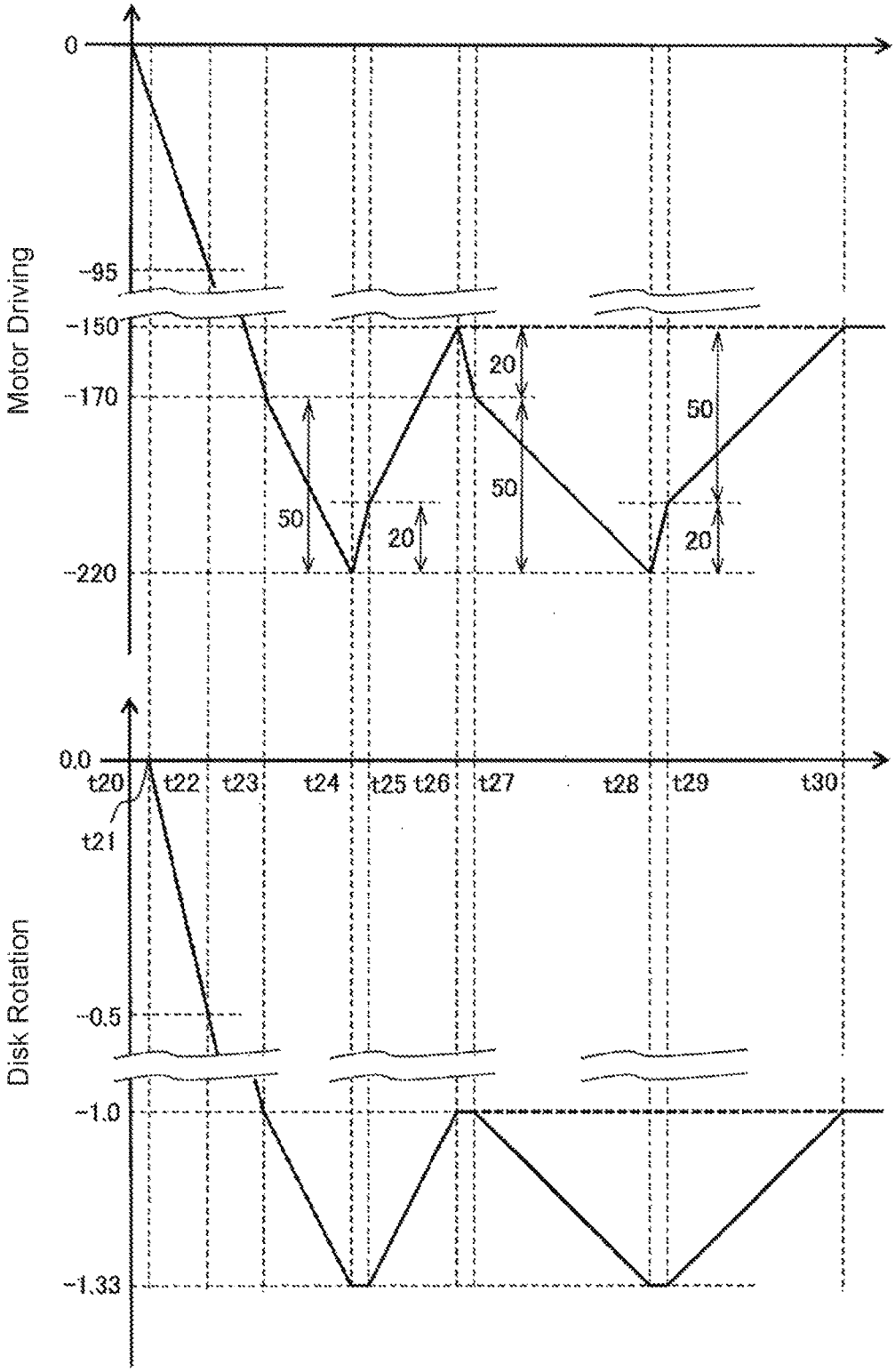
FIG. 7 is a graph illustrating an example of operations in a reverse rotation direction.

FIG. 7 is a graph illustrating an example of the operations in the reverse rotation direction. FIG. 8 is a diagram illustrating an example of the display during reverse rotation. The graph in the upper part of FIG. 7 indicates the driving steps of the stepping motor 32*c*, whereas the graph in the lower part indicates the movement of the disk 23. The horizontal axes in both graphs indicate corresponding times. FIG. 8 illustrates the signs (information) displayed in the window 24 at some of the times indicated in FIG. 7.

Figure 8:
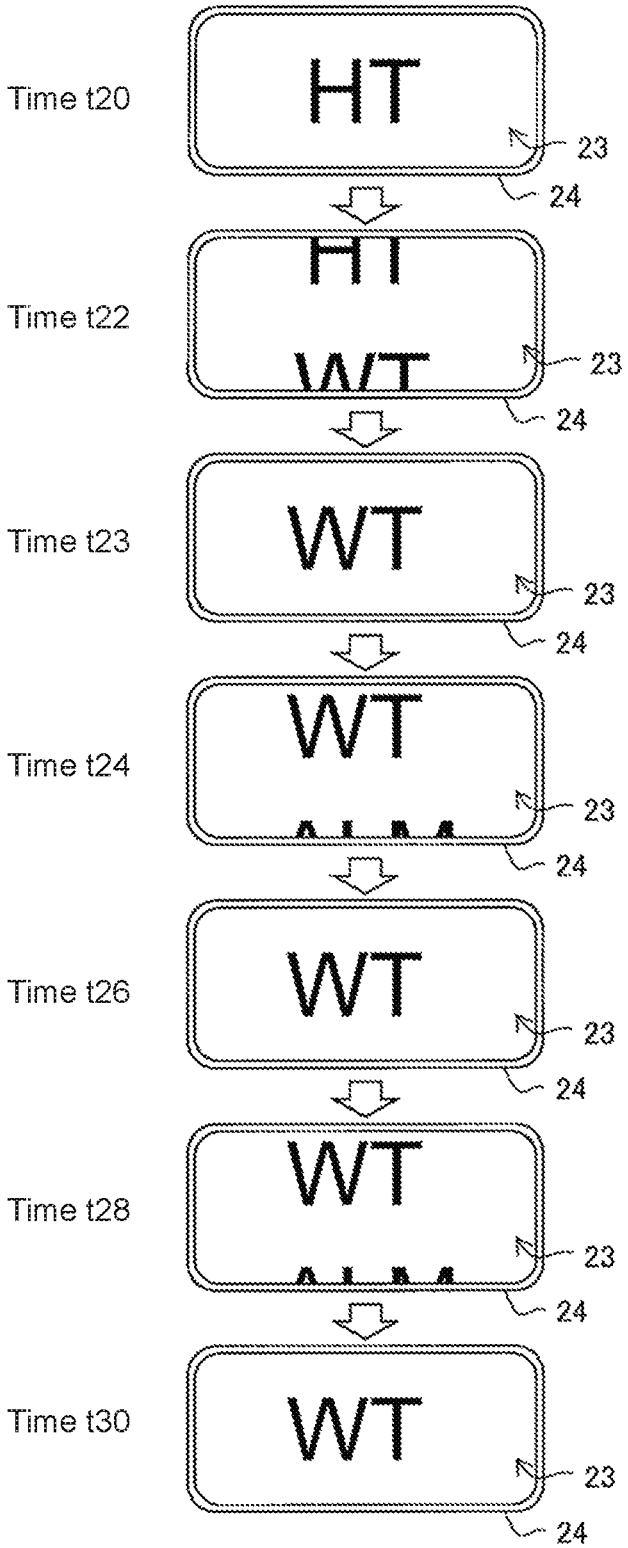
FIG. 8 is a diagram illustrating an example of a display during reverse rotation.

As illustrated in FIG. 8, at time t20, the disk 23 displays "HT" in the center of the window 24. The following descriptions will assume that this position corresponds to a driving step of 0 and a rotation of 0 for the disk 23.

As illustrated in FIG. 7, from time t20 to time t23, the stepping motor 32*c* rotates in the reverse rotation direction for 170 steps at a speed of 200 pps. From time t20 to time t21, the disk 23 does not rotate due to backlash in the reverse rotation direction. At time t21, the driving step is −20, and because backlash in the reverse rotation direction can be taken up, the disk 23 begins to rotate in the reverse rotation direction.

Time t22 is midway between time t21 and time t23. As illustrated in FIG. 8, at time t22, the disk 23 displays a position midway between "HT" and "WT" in the window 24. As illustrated in FIG. 7, at time t22, the driving step is 95 and the rotation of the disk 23 is 0.5.

As illustrated in FIG. 8, at time t23, the disk 23 displays "WT" in the center of the window 24. As illustrated in FIG. 7, at time t23, the driving step is 170 and the rotation of the disk 23 is −1.0. Then, from time t23 to time t24, the stepping motor 32*c* rotates in the reverse rotation direction for 50 steps at 100 pps.

This enables the electronic timepiece 1 to shift the sign displayed in the window 24 upward.

As illustrated in FIG. 8, at time t24, the disk 23 displays "WT" in the upper part of the window 24. As illustrated in FIG. 7, at time t24, the driving step is −220 and the rotation of the disk 23 is −1.33. Then, from time t24 to time t25, the stepping motor 32*c* rotates in the normal rotation direction for 20 steps at 200 pps. This makes it possible to take up backlash in the normal rotation direction.

At time t25, the disk 23 continues to display "WT" in the upper part of the window 24. At this time, the driving step is −200 and the rotation of the disk 23 is −1.33.

Then, from time t25 to time t26, the stepping motor 32*c* rotates in the normal rotation direction for 50 steps at 100 pps. This enables the electronic timepiece 1 to return the sign that was shifted upward back to the center of the window 24.

At time t26, in the case where the disk 23 displays "HT," "WT," or "ALM" in the center of the window 24, one additional swing-back is carried out, as indicated by the bold solid line. However, in the case where the disk 23 displays a sign aside from the "HT," "WT," or "ALM" in the center of the window 24, the disk 23 stops, as indicated by the bold broken line.

Here, as illustrated in FIG. 8, at time t26, the disk 23 displays "WT" in the center of the window 24, and thus the operation is as indicated by the bold solid line. This operation will be described next.

From time t26 to time t27, the stepping motor 32*c* rotates in the reverse rotation direction for 20 steps at 200 pps. This makes it possible to take up backlash in the reverse rotation direction.

At time t27, the driving step is −170 and the rotation of the disk is −1.0. From time t27 to time t28, the stepping motor 32*c* rotates in the reverse rotation direction for 50 steps at 50 pps. This enables the electronic timepiece 1 to shift the sign displayed in the window 24 upward.

As illustrated in FIG. 8, at time t28, the driving step is −220 and the rotation of the disk is −1.33. The second swing-back is carried out in this manner. From time t28 to time t29, the stepping motor 32*c* rotates in the normal rotation direction for 20 steps at 200 pps. This makes it possible to take up backlash in the normal rotation direction.

At time t29, the driving step is −200 and the rotation of the disk is −1.33. Then, from time t29 to time t30, the stepping motor 32*c* rotates in the normal rotation direction for 50 steps at 100 pps. This enables the electronic timepiece 1 to return the sign that was shifted upward back to the center of the window 24, as indicated by time t30 in FIG. 8.

These stopping operations using swing-back makes it possible for the electronic timepiece 1 to clearly indicate the timing at which the disk stops to the user. Furthermore, by carrying out the stopping operations in accordance with the mode, the electronic timepiece 1 can make the mode to be displayed obvious to the user.

The electronic timepiece 1 according to the present embodiment carries out more swing-backs the broader the classification of the mode, and thus the fact that the mode being displayed is in a broader classification can be made obvious.

(Variations)

The present invention is not limited to the embodiment described above, and variations can be made on the embodiments without departing from the essential spirit of the present invention. Such variations include the following (a) to (c), for example.

(a) The present invention is not limited to an electronic timepiece, and may be applied in any information display device, such as measuring instruments and mobile devices.

(b) The stopping operations are not limited to swing-back operations after moving to the set position, and may be any operations, such as a deceleration operation carried out immediately before movement to the set position stops or dampening vibrations arising at the end of movement to the set position.

(c) The stopping operation according to the present invention is not limited to the disk-shaped functional hand, and may also be applied in the second hand, the minute hand, the hour hand, and so on. When information aside from the time (modes or the like) is also to be displayed by the second hand, the minute hand, the hour hand, or the like, the stopping operations may be carried out by the hand in accordance with the information to be displayed.

It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An information display device, comprising:

an information indicator having thereon a plurality of information pieces to be selectively displayed to a user through a window, the window being configured such that only one of the information pieces on the information indicator is visible to the user at a time at a designated position of the information indicator that corresponds to the one of the information pieces, the information indicator being movable to a plurality of designated positions at which only respective one of the plurality of information pieces can be seen from the window;

a position changing unit that changes a position of the information indicator to one of the designated positions so as to display one of the information pieces to the user through the window; and an operation unit that causes the position changing unit to change the position of the information indicator that has been showing one of the plurality of the information pieces to a new position at which another one of the information pieces will be shown through the window, the operation unit causing the position changing unit to perform a movement completion operation that includes visibly swinging the information indicator upon or near a completion of changing the position of the information indicator to the new position so as to indicate to the user that the window now shows said another one of the information pieces, wherein said plurality of information pieces are grouped into two or more separate groups, and the movement completion operation performed when said another one of the information pieces belongs to one of the groups is different from the movement completion operation performed when said another one of the information pieces belongs to another one of the groups, wherein the movement completion operation is performed such that said another one of the information pieces is recognizable by the user during the movement completion operation, wherein the movement completion operation is moving the information indicator backwards from the new position up to a prescribed distance for a prescribed duration of time and returning the information indicator to the new position thereafter, and repeatedly performing said moving backwards from the new position and returning to the new position for a plurality of times in succession, and wherein in the movement completion operation, a speed at which said moving backwards from the new position and said returning to the new position are performed for a first time and a speed at which said moving backwards and said returning to the new position are performed for a subsequent time are different from each other.

2. The information display device according to claim 1, wherein the movement completion operation is performed such that said one of the information pieces and said another one of the information pieces are both recognizable by the user during the movement completion operation.

3. The information display device according to claim 1, wherein the number of the repetition is greater when said another one of the information pieces to be displayed belongs to a prescribed group than when said another one of the information pieces to be displayed does not belong the prescribed group.

4. The information display device according to claim 1, wherein a speed at which the information indicator moves in the movement completion operation is different from a speed at which the information indicator moves to the new position.

5. The information display device according to claim 1, wherein the information indicator comprises a disk having a plurality of texts thereon, as said plurality of information pieces, the disk being configured to be rotatable about an axis.

6. The information display device according to claim 5, wherein the plurality of texts on the disk includes letters indicating that the information display device is displaying a home time.

7. The information display device according to claim 5, wherein the plurality of texts on the disk includes letters indicating that the information display device is displaying a world time.

8. The information display device according to claim 5, wherein the plurality of texts on the disk includes letters indicating that the information display device is displaying a daylight saving time.

9. The information display device according to claim 5, wherein the plurality of texts on the disk includes letters indicating that the information display device is displaying a standard time.

10. The information display device according to claim 1, wherein in the movement completion operation, the speed at which said moving backwards from the new position and said returning to the new position are performed for the first time is faster than the speed at which said moving backwards and said returning to the new position are performed for the subsequent time.

11. A computer-readable non-transitory storage medium having stored therein instructions executable by a processor of an information display device including: an information indicator having thereon a plurality of information pieces to be selectively displayed to a user through a window, the window being configured such that only one of the information pieces on the information indicator is visible to the user at a time at a designated position of the information indicator that corresponds to the one of the information pieces, the information indicator being movable to a plurality of designated positions at which only respective one of the plurality of information pieces can be seen from the window; and a position changing unit that changes a position of the information indicator, said instructions causing the processor to perform the following:

causing the position changing unit to change the position of the information indicator to one of the designated positions so as to display one of the information pieces to the user through the window; and causing the position changing unit to change the position of the information indicator that has been showing one of the plurality of the information pieces to a new position at which another one of the information pieces will be shown through the window, the position changing unit being caused to perform a movement completion operation that includes visibly swinging the information indicator upon or near a completion of changing the position of the information indicator to the new position so as to indicate to the user that the window now shows said another one of the information pieces, wherein said plurality of information pieces are grouped into two or more separate groups, and the movement completion operation performed when said another one of the information pieces belongs to one of the groups is different from the movement completion operation performed when said another one of the information pieces belongs to another one of the groups, wherein the movement completion operation is performed such that said another one of the information pieces is recognizable by the user during the movement completion operation, wherein the movement completion operation is moving the information indicator backwards from the new position up to a prescribed distance for a prescribed duration of time and returning the information indicator to the new position thereafter, and repeatedly performing said moving backwards from the new position and returning to the new position for a plurality of times in succession, and wherein in the movement completion operation, a speed at which said moving backwards from the new position and said returning to the new position are performed for a first time and a speed at which said moving backwards and said returning to the new position are performed for a subsequent time are different from each other.

12. The computer-readable non-transitory storage medium according to claim 11, wherein in the movement completion operation, the speed at which said moving backwards from the new position and said returning to the new position are performed for the first time is faster than the speed at which said moving backwards and said returning to the new position are performed for the subsequent time.

* * * * *